US012061065B2

(12) United States Patent
Peterson et al.

(10) Patent No.: US 12,061,065 B2
(45) Date of Patent: Aug. 13, 2024

(54) INTERCHANGEABLE, MULTI LOCATION, MULTI CANT, AUTO LOCKING, QUICK MOUNT FOR HOLSTERS, HANDHELD DEVICES, AND CARRIED GEAR

(71) Applicant: Blade-Tech Industries, Inc., Streetsboro, OH (US)

(72) Inventors: Jarett Peterson, Alliance, OH (US); Tyler Johnson, Oberlin, OH (US)

(73) Assignee: BLADE-TECH INDUSTRIES, INC., Streetsboro, OH (US)

( * ) Notice: Subject to any disclaimer, the term of this patent is extended or adjusted under 35 U.S.C. 154(b) by 0 days.

(21) Appl. No.: 17/729,361

(22) Filed: Apr. 26, 2022

(65) Prior Publication Data

US 2023/0341211 A1 Oct. 26, 2023

(51) Int. Cl.
*F41C 33/04* (2006.01)

(52) U.S. Cl.
CPC ..... *F41C 33/045* (2013.01)

(58) Field of Classification Search
CPC ..... A45F 2005/025; A45F 2005/026; A45F 2005/027; A45F 2005/028; A45F 5/02; A45F 2200/0591; F41C 33/045
See application file for complete search history.

(56) References Cited

U.S. PATENT DOCUMENTS 3,117,708 A 1/1964 Goldman
3,261,519 A 7/1966 Horne
5,641,102 A 6/1997 Hellweg
6,161,741 A * 12/2000 French ..... F41C 33/0227 224/198
6,189,751 B1 2/2001 Tsering
7,093,742 B2 8/2006 Steven, III et al.
8,100,304 B2 1/2012 Tanzinni
8,251,266 B2 8/2012 Gregory et al.
8,469,245 B2 6/2013 Gregory et al.
8,517,234 B2 * 8/2013 Kincaid ..... F41C 33/045 224/198
8,783,532 B2 * 7/2014 Gregory ..... F41C 33/045 224/198
9,383,774 B2 7/2016 Whitten et al.
10,782,094 B2 9/2020 Rogers et al.
2002/0139822 A1 10/2002 Infanti
2018/0059516 A1 * 3/2018 Taylor ..... F16M 13/022

* cited by examiner

*Primary Examiner* — Corey N Skurdal
(74) *Attorney, Agent, or Firm* — Emerson, Thomson & Bennett, LLC; Roger D. Emerson

(57) ABSTRACT

Provided in this disclosure is a interchangeable, multi location, multi cant, auto locking, quick mount structure for a holster, for a firearm, hand held device, carried gear or the like. The interchangeable, multi location, multi cant, auto locking, quick mount includes an insert plate having a generally circular profile and configured for securement to a receptacle (e.g., a holster or magazine pouch) for removably retaining a hand-held device (e.g., a firearm or ammunition magazine. A receiver platform is configured for mounting to an engagement surface (such as a gun belt) for removably receiving the insert plate. An internal track is formed on the receiver platform and has a generally circular profile configured to mate with and retain the generally circular profile of the insert plate. In this manner, rotation of the insert plate is enabled to a selected mounting angle with respect to the receiver platform.

13 Claims, 10 Drawing Sheets

INTERCHANGEABLE, MULTI LOCATION, MULTI CANT, AUTO LOCKING, QUICK MOUNT FOR HOLSTERS, HANDHELD DEVICES, AND CARRIED GEAR

I. BACKGROUND

A. Technical Field

This invention generally pertains to the field of interchangeable, multi location, quick mount structures used for the purpose of quickly transferring holstered firearms, hand-held devices, and carried gear to a variety of predetermined attachment locations on and off the users body. The invention specifically pertains to the field of securing carried gear and carried gear receptacles for use with firearms, magazines, radios, cell phones, flashlights, knives, tourniquets, Medical supplies, Etc. to a variety of predetermined attachment points which allow the user to rearrange the location and orientation of their various carried items in a speedy manner without the use of tools.

B. Description of Related Art

It is known in the art to have holsters for carrying firearms and various other hand held items or carried gear. Holsters are typically mounted on the user's belt, duty vest, thigh rig, backpack etc. Oftentimes holsters are mounted to surfaces such as vehicle dashboards, nightstands, desks, and other suitable locations.

It is common in the art to change the mounted location of one's holster which is typically mounted to allow the user easy access for drawing or removing the item carried in said holster. A holster is typically mounted at a suitable location on the wearer's hip or any other readily accessible location that enables the wearer's hand to quickly grab and gain control of the firearm or carried item.

It is also known in the art that a holster should be mounted at a suitable cant, which is an angle to which the holstered item is oriented to be best reachable by the user, in order to quickly grip and establish control of the holstered item. The art includes other types of holsters and other such mounting structures that enable the mounting of a holster at a suitable cant or mounting angle.

However, such mounting structures can be complicated and expensive to manufacture, and they can be difficult to operate and feature a limited number of angles at which the user may adjust the cant. In other instances these mounting structures are unreliable at maintaining their set cant. Furthermore, such structures are not adaptable for a variety of different implementations and require the use of screws and posts to maintain or change the cant position. For example, a belt-mounted holster does not convert from a "straight drop (0 degree)" position to a "FBI cant (15 degree)" position without the use of screws and posts. Other mounting structures require interaction with a static lock that requires the lock to be defeated and the holster or carried item to be completely removed from the mounting structure before re entering the mount at the desired cant and reengaging the locking mechanism manually. There is a need for an interchangeable, multi location, multi cant, auto locking, quick mount structure that overcomes these aforementioned drawbacks.

II. SUMMARY

Provided in this disclosure is an interchangeable, multi location, multi cant, auto locking, quick mount structure which can be adapted for use with a firearm holster, or other such structures for use with supporting other types of hand-held devices and carried gear. The present an interchangeable, multi location, multi cant, auto locking, quick mount structure includes an insert plate having a generally circular profile and configured for securement to a receptacle for removably retaining a hand-held device, where as the receptacle can be a holster and the carried device can be a gun. A receiver platform is configured for mounting to an engagement surface, for removably receiving the insert plate. An internal track of the receiver platform has a generally circular profile configured to mate with and retain the generally circular profile of the insert plate. This configuration enables rotation of the insert plate to a selected mounting angle with respect to the receiver platform. A lock mechanism is provided for releasably locking the insert plate at the selected mounting angle.

The present an interchangeable, multi location, multi cant, auto locking, quick mount structure can also include internal gear teeth formed onto a periphery of the generally circular profile of the insert plate. External gear teeth can be formed on a periphery of a circular sector within the internal track of the receiver platform. The internal and external gear teeth are configured for mating engagement to enable the rotation of the insert plate to the selected mounting angle with respect to the receiver platform. The external gear teeth can be formed around any segment of the entire circumference of the periphery of the generally circular profile of the insert plate, to enable 360 degrees of rotation of the insert plate with respect to the receiver platform.

The lock mechanism can further include a spring loaded lock received within the receiver platform, which itself can include the aforementioned circular sector having the external gear teeth. The spring loaded lock is pivotally mounted to admit the insert plate into engagement with the internal track, and to retain the insert plate in non-rotatable engagement of the external gear teeth with the internal gear teeth of the insert plate. A lock release tab is configured for manual pivotal displacement of the spring loaded lock to enable rotation of the insert plate with respect to the receiver platform by disengaging the external gears from the internal gears, and to enable removal of the insert plate from the receiver platform.

The lock mechanism can also include a secondary lock for rotationally blocking the manual pivotal displacement of the spring loaded lock. This secondary lock prevents disengagement of the external gears from the internal gears. This prevents rotation and removal of the insert plate with respect to the receiver platform. The insert plate can include a plurality of mounting holes for receiving fasteners for securing the insert plate to a plurality of mating mounting holes, which are formed on the receptacle for removably retaining the hand-held device. The receiver platform includes a first section and a second section configured in a mating arrangement. The internal track is formed integrally on an interior surface of the first section, in order to mate with a respective facing surface of the second section.

In a preferred embodiment, the receptacle is a holster for removably retaining a firearm. Alternatively, the receptacle is a magazine pouch for removably retaining a magazine of ammunition for a firearm. The engagement surface can be a gun belt of a wearer. Alternatively, the engagement surface can be the dashboard of a vehicle. The mounting angle is preferably a cant angle of a firearm holster. However, any of the foregoing components can be adapted for any other suitable implementations without departing from the invention.

In another aspect, an interchangeable, multi location, multi cant, auto locking, quick mount structure is provided including a generally circular insert plate configured for securement to a holster for removably retaining a firearm. A receiver platform is configured for mounting to a gun belt of a wearer, for removably receiving the insert plate. An internal track of the receiver platform has a generally circular profile configured to mate with and retain the generally circular profile of the insert plate. This enables rotation to a selected mounting angle of the insert plate with respect to the receiver platform. Internal gear teeth are formed onto a periphery of the generally circular profile of the insert plate. External gear teeth are formed on a periphery of a circular sector within the internal track of the receiver platform. The internal and external gear teeth are configured for mating engagement to enable the rotation of the insert plate to the selected mounting angle with respect to the receiver platform. A lock mechanism is provided for releasably locking the insert plate at the selected mounting angle. The lock mechanism also includes a spring loaded lock received within the receiver platform. The circular sector of the spring loaded lock has the external gear teeth. The spring loaded lock is pivotally mounted to admit the insert plate into engagement with the internal track, and to retain the insert plate in non-rotatable engagement of the external gear teeth with the internal gear teeth of the insert plate. A lock release tab is configured for manual pivotal displacement of the spring loaded lock to enable rotation of the insert plate with respect to the receiver platform by disengaging the external gears from the internal gears, and to enable removal of the insert plate from the receiver platform.

According to an aspect, the invention provides an interchangeable, multi location, multi cant, auto locking, quick mount structure that is uncomplicated and inexpensive to manufacture.

According to another aspect, the invention provides an interchangeable, multi location, multi cant, auto locking, quick mount structure that is easy to set and maintain the cant.

According to yet another aspect, the invention provides an interchangeable, multi location, multi cant, auto locking, quick mount structure that is adaptable for a variety of different implementations, such as a belt-mounted arrangement that is readily adaptable for dashboard mounting on a vehicle.

Other benefits and advantages of this invention will become apparent to those skilled in the art to which it pertains upon reading and understanding of the following detailed specification.

III. BRIEF DESCRIPTION OF THE DRAWINGS

The disclosed interchangeable, multi location, multi cant, auto locking, quick mount structure may take physical form in certain parts and arrangement of parts, embodiments of which will be described in detail in this specification and illustrated in the accompanying drawings which form a part hereof and wherein.

Figure 3:
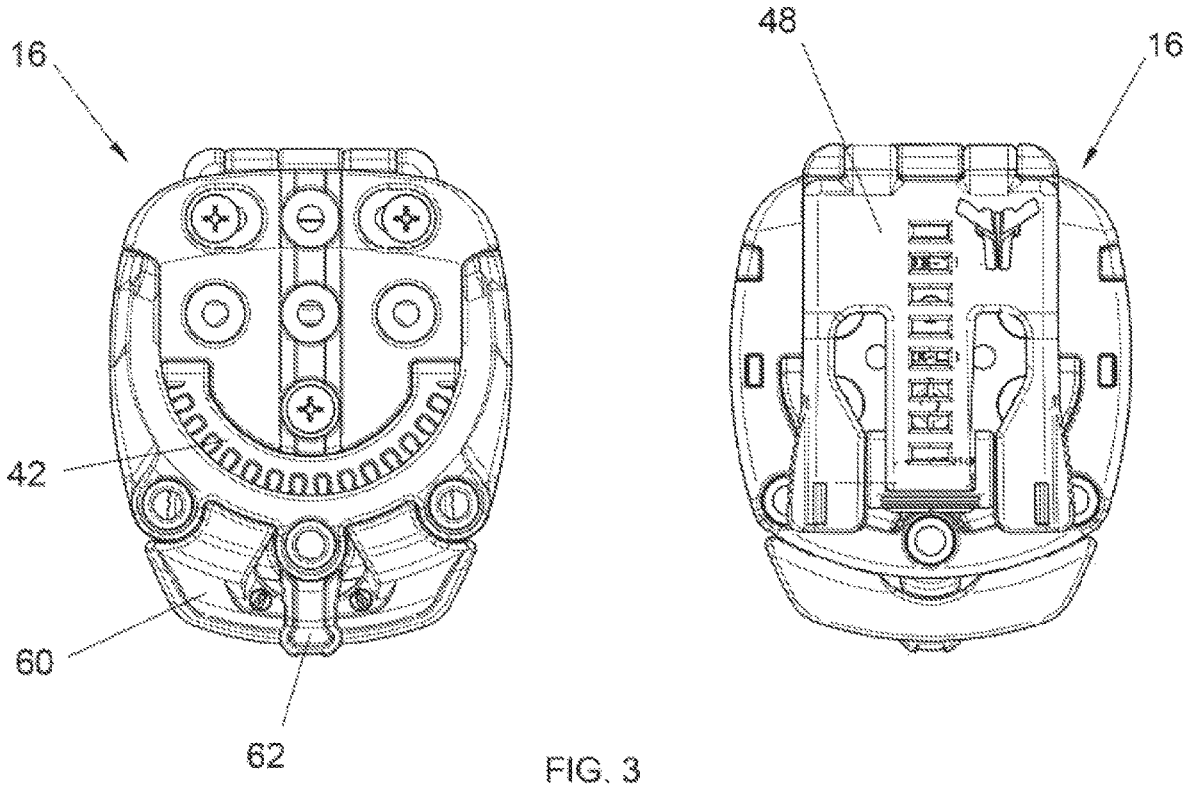

FIG. 3 includes obverse and reverse views of the receiver platform according to an exemplary embodiment.

Figure 4:
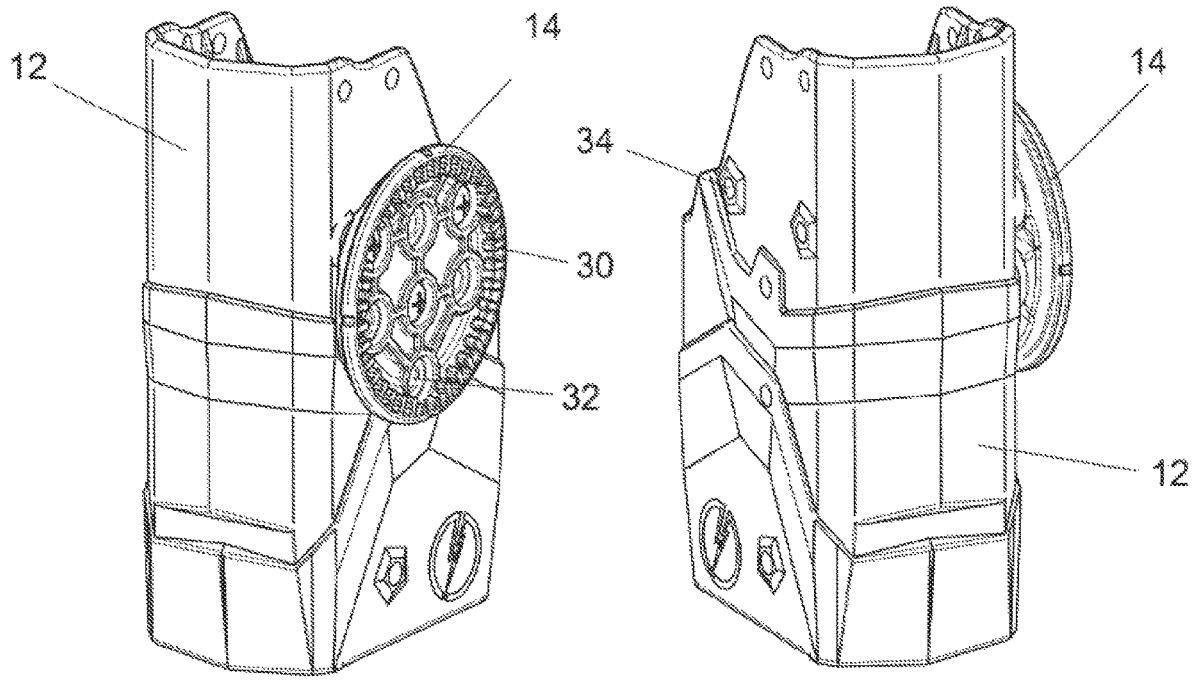

FIG. 4 includes respective oblique views of the holster with insert plate according to an exemplary embodiment.

Figure 5:
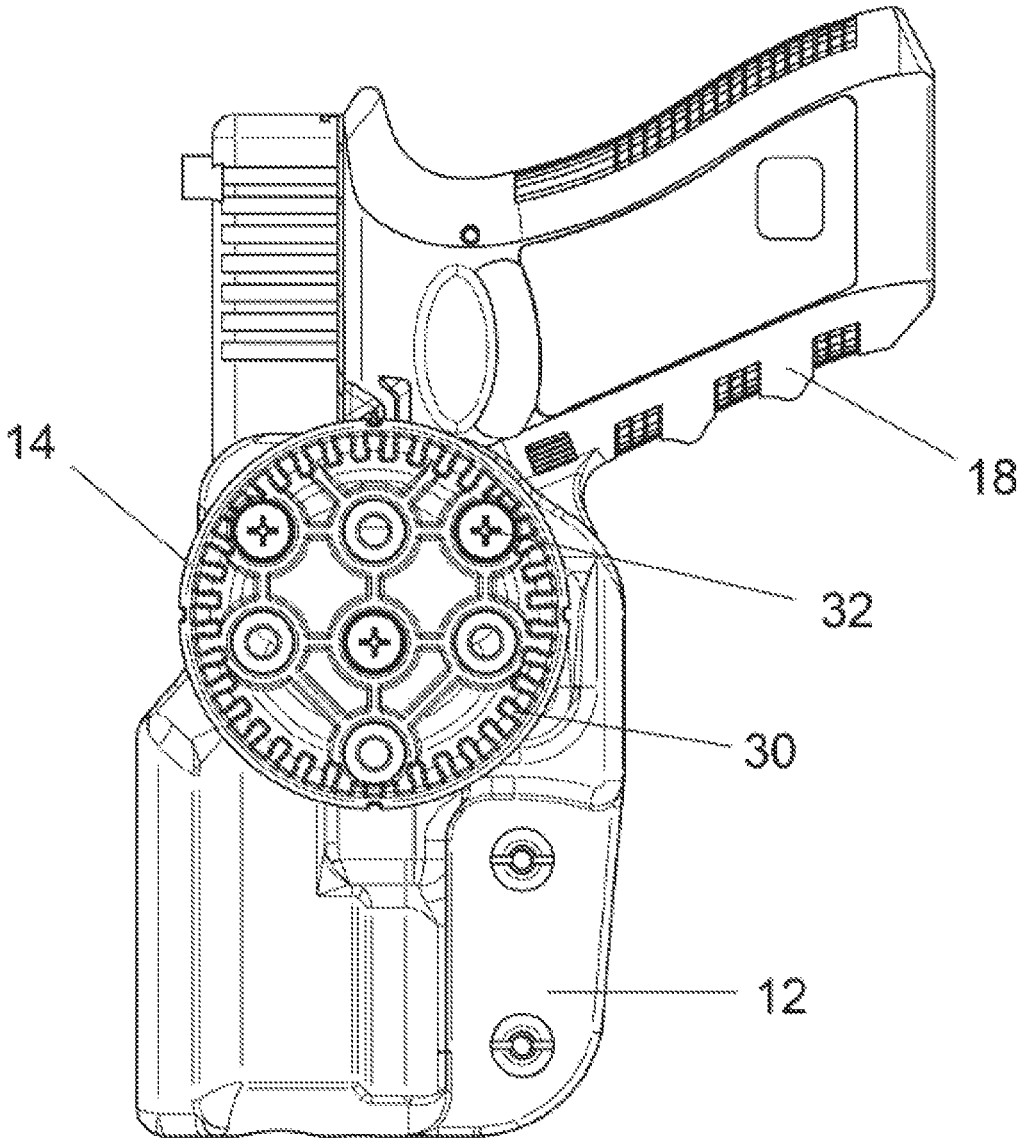

FIG. 5 includes the holster with insert plate receiving a gun according to an exemplary embodiment.

Figure 6:
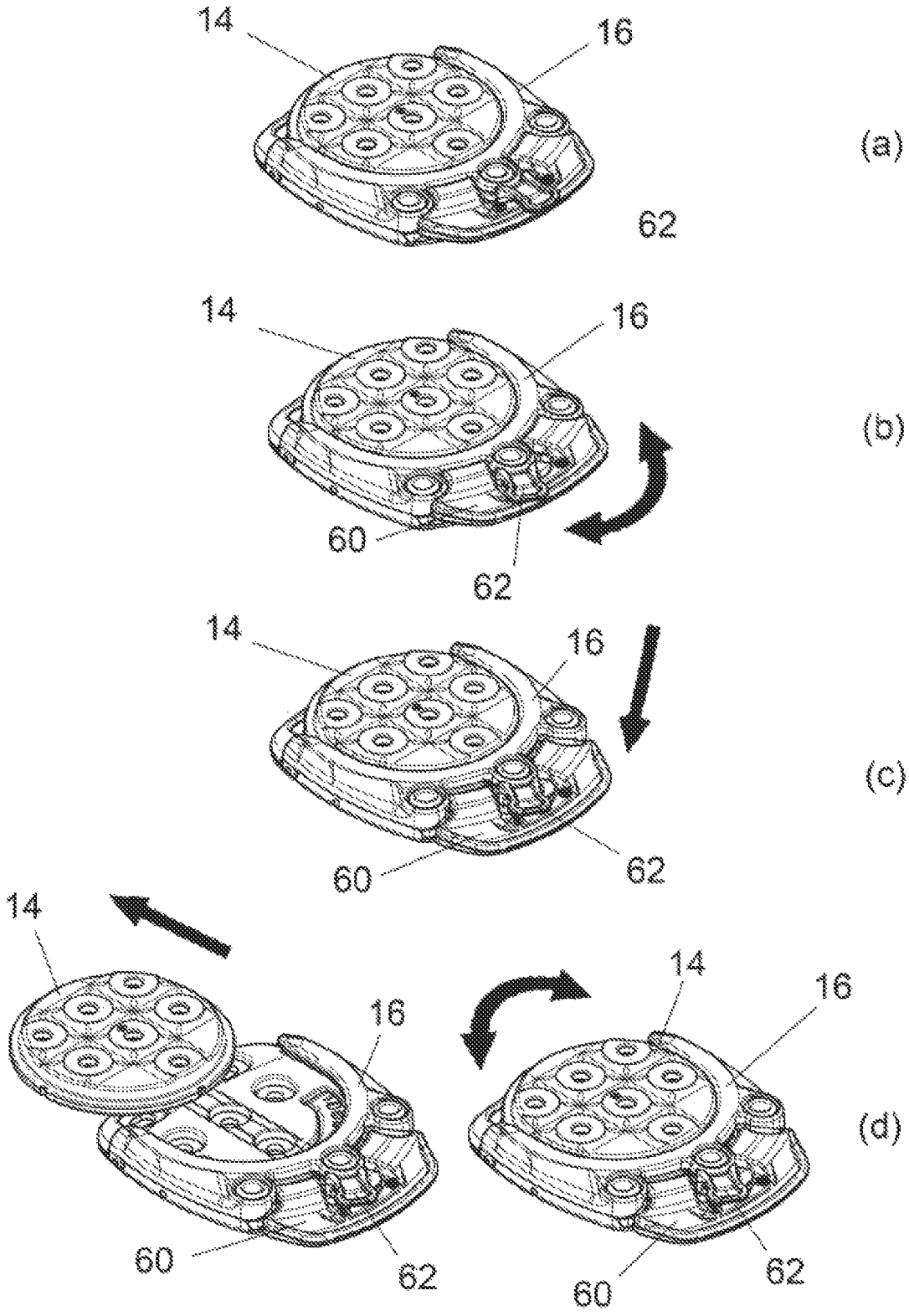

FIG. 6 includes multiple operative views depicting interaction of the receiver platform and lock mechanism with the insert plate according to an exemplary embodiment.

Figure 7:
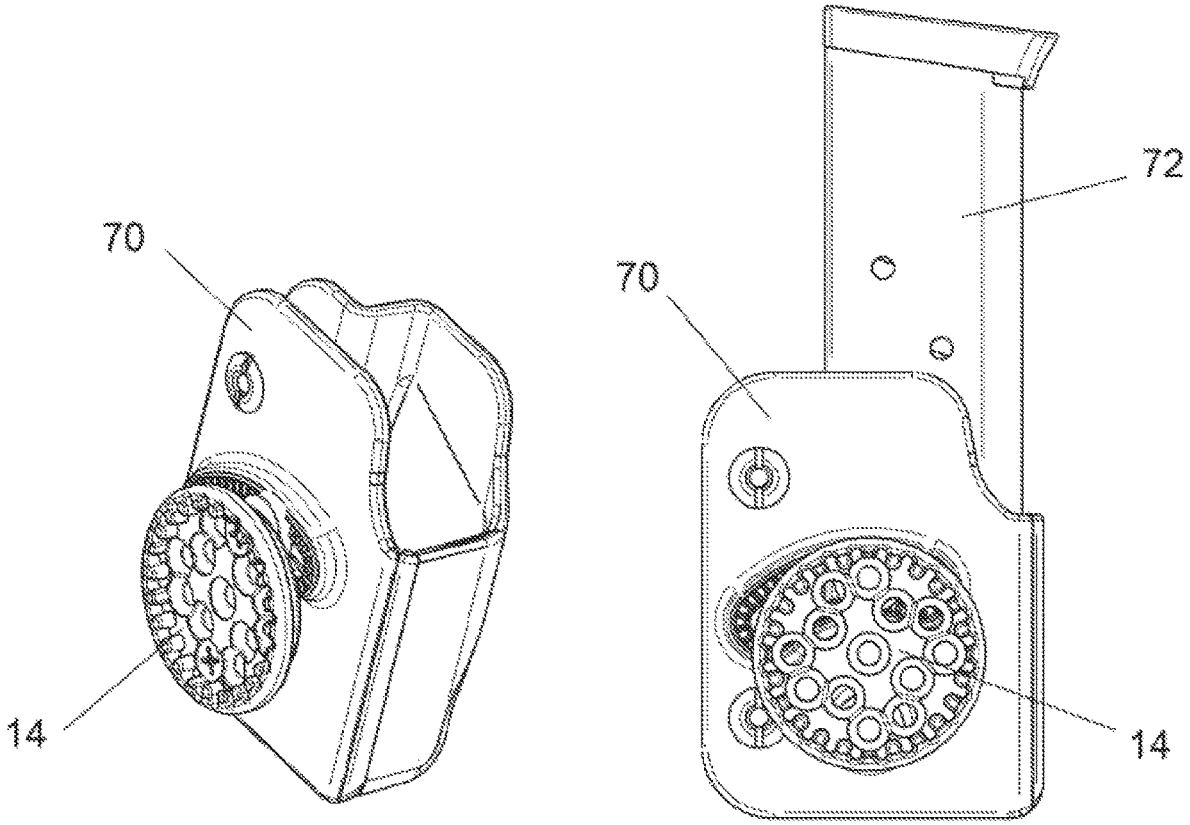

FIG. 7 includes oblique and side views of a magazine pouch with insert plate with and without a ammunition magazine according to an exemplary embodiment.

Figure 8:
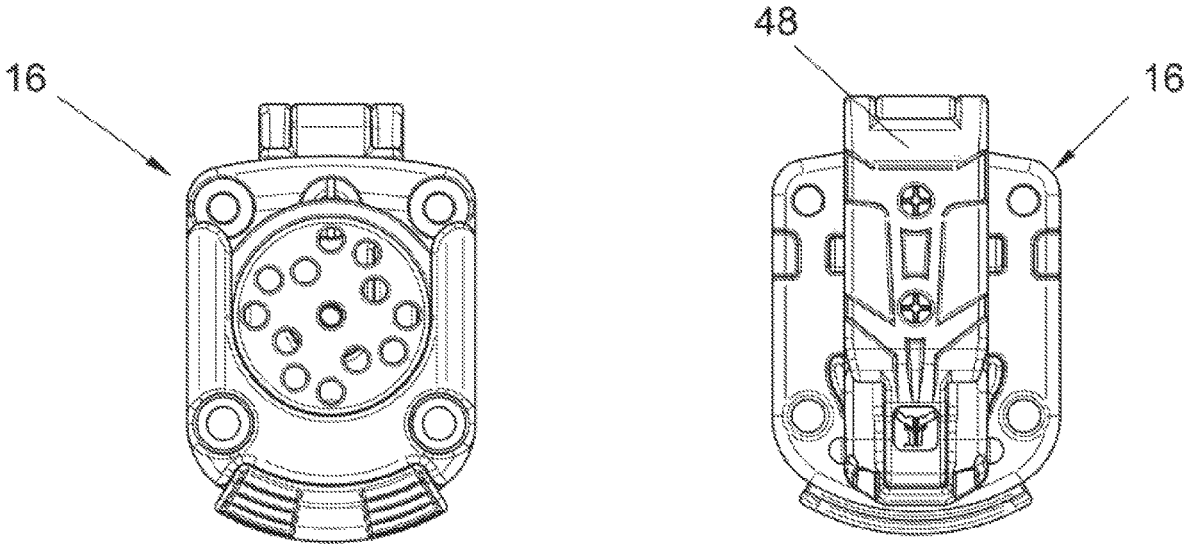

FIG. 8 includes obverse and reverse views of a receiver platform for a magazine pouch according to an exemplary embodiment.

Figure 9B:
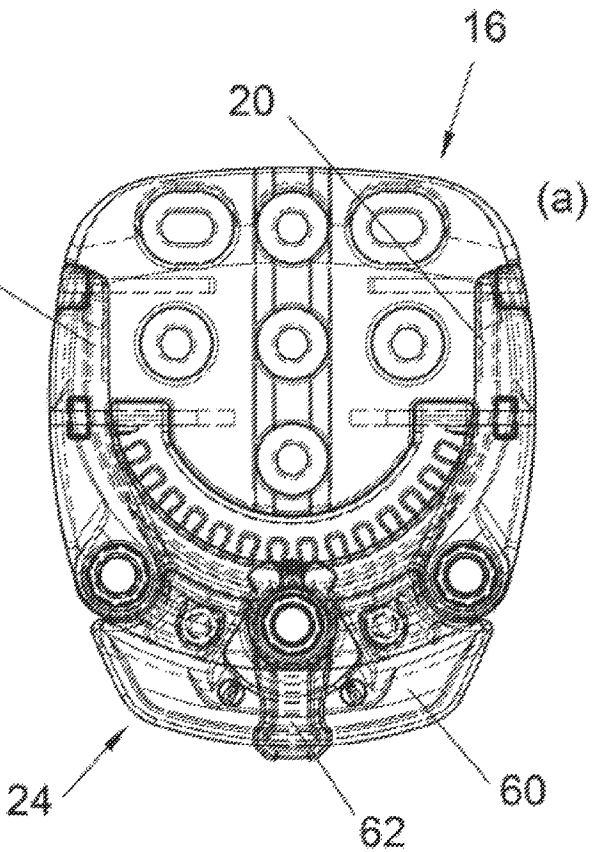
Figure 9A:
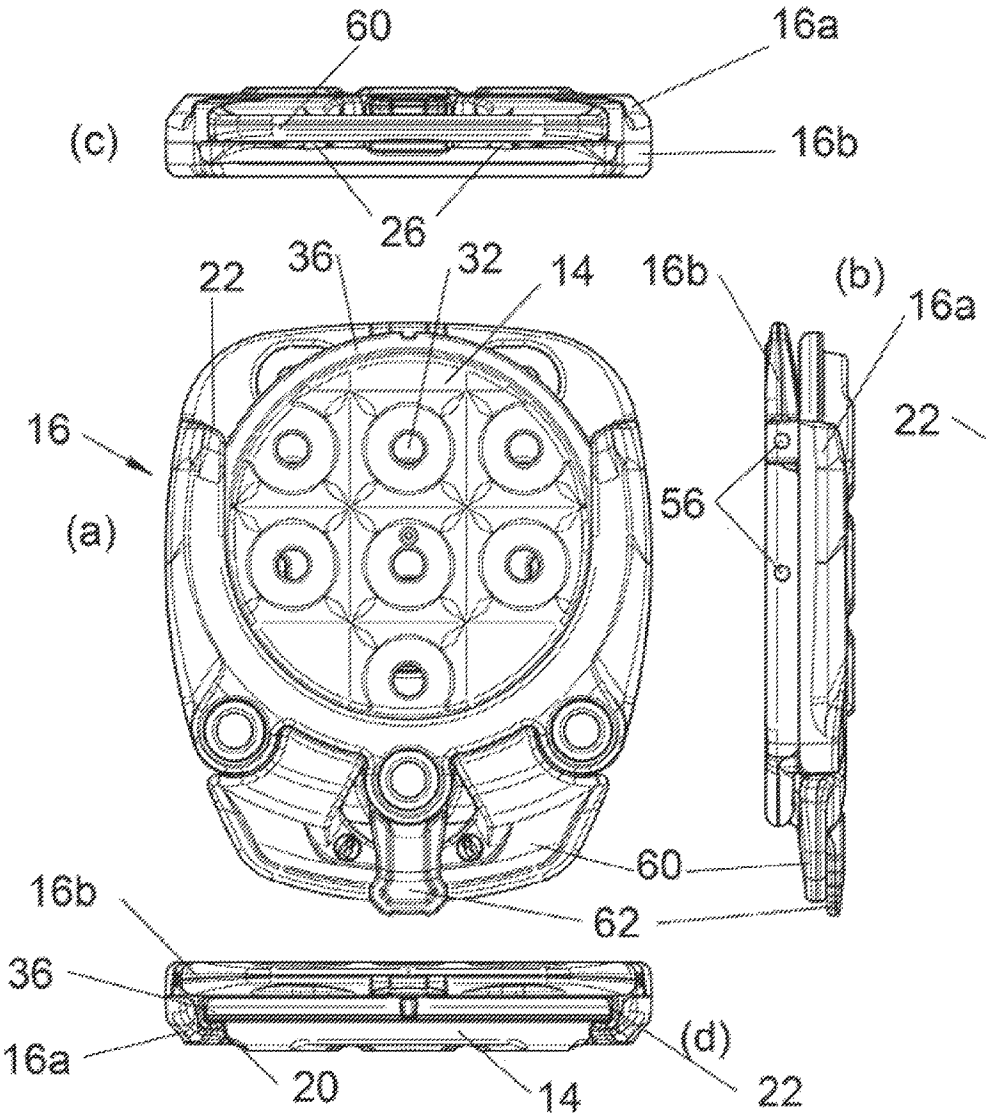

FIGS. 9A and 9B include respective observe and obverse phantom views of the receive platform according to an exemplary embodiment.

Figure 10:
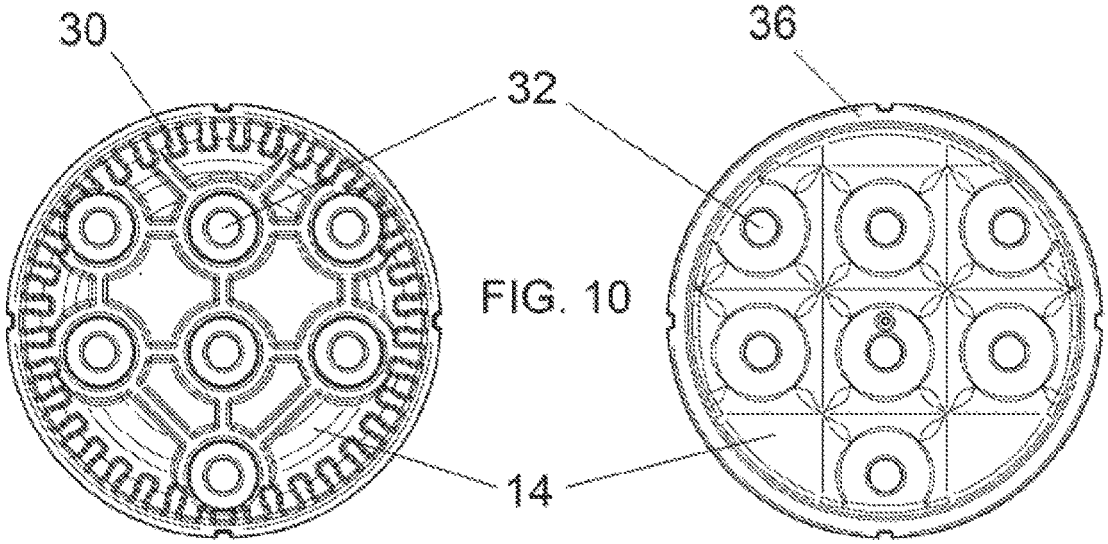

FIG. 10 includes obverse and reverse views of the insert plate according to an exemplary embodiment.

Figure 11:
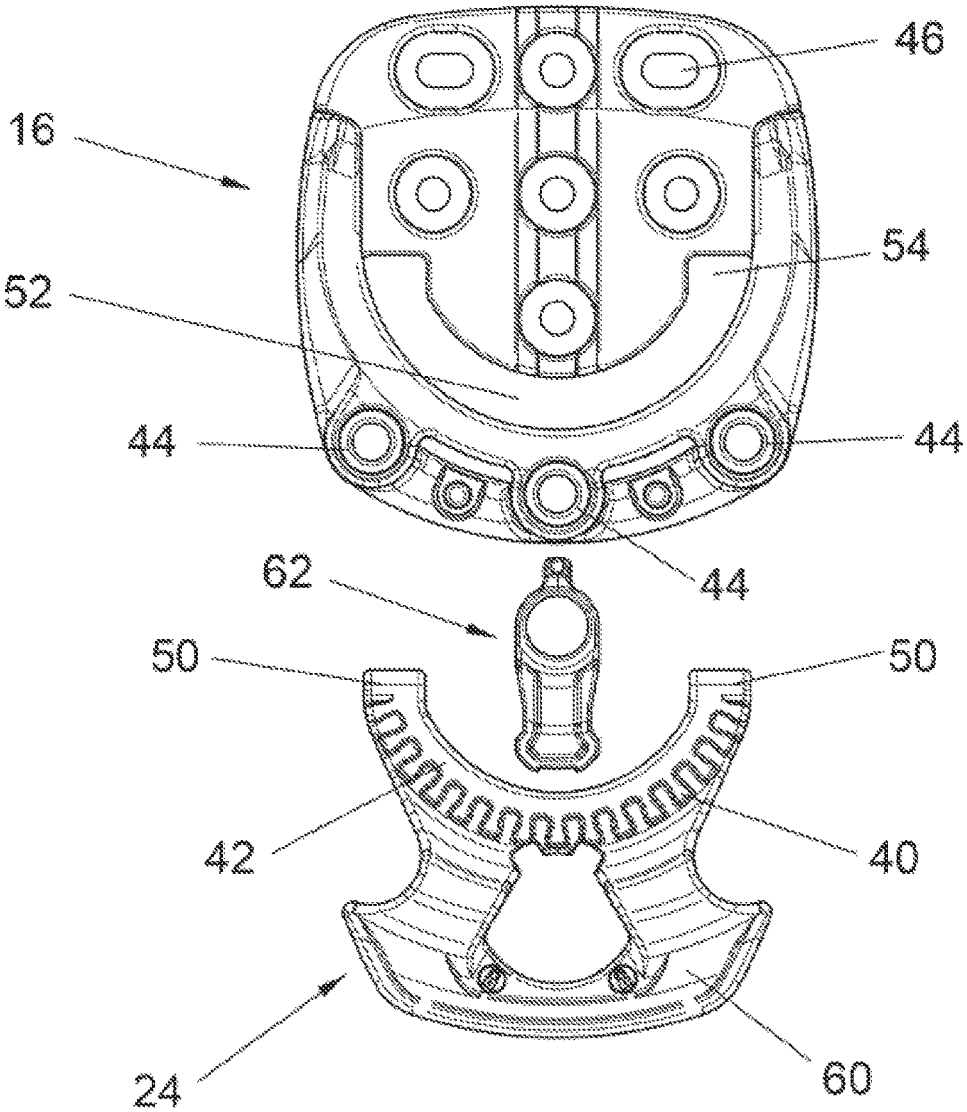

FIG. 11 is a disassembled view of the receiver platform and lock mechanism according to an exemplary embodiment.

Figure 12:
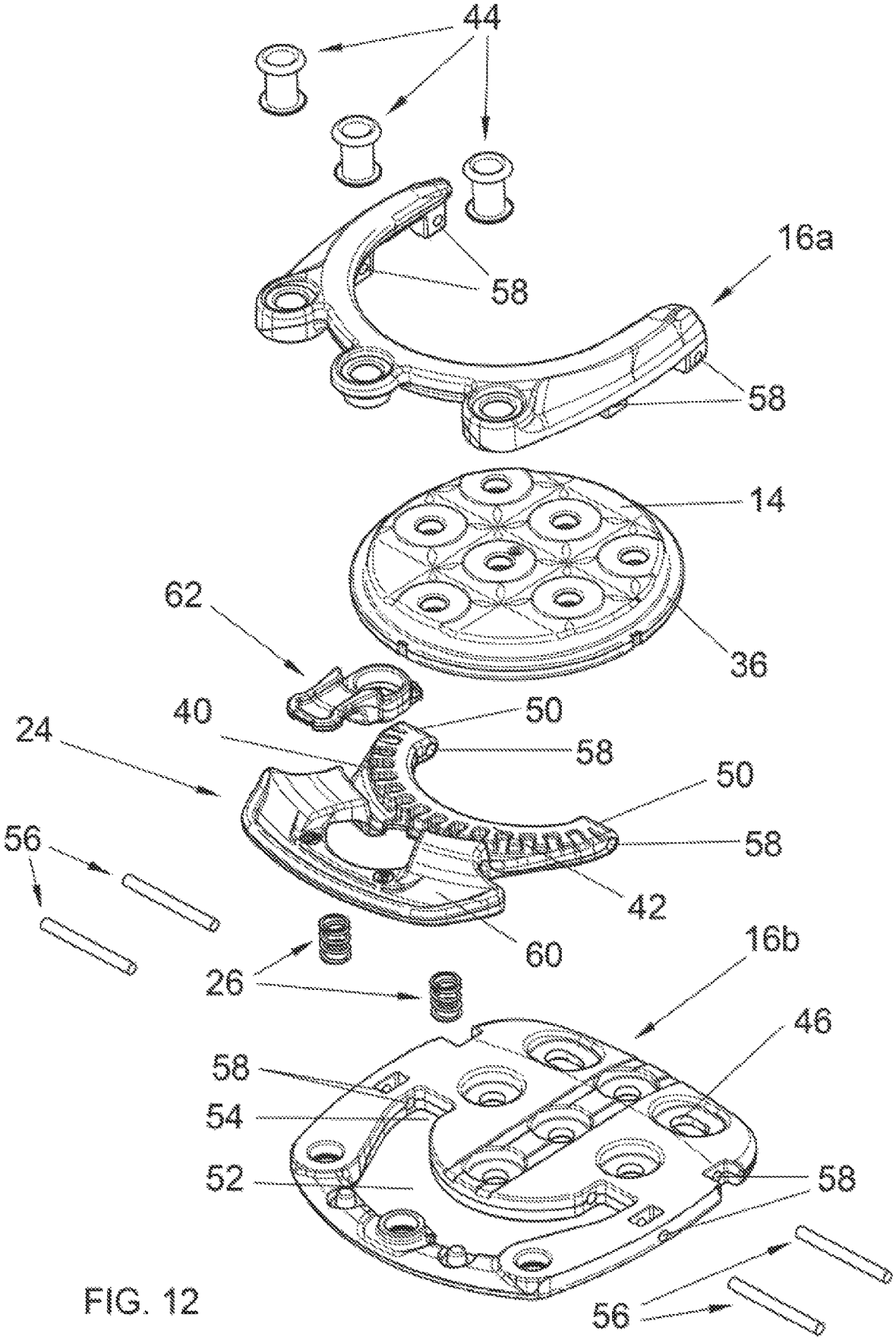

FIG. 12 is an exploded view of the receiver platform according to an exemplary embodiment.

IV. DETAILED DESCRIPTION

Figure 1:
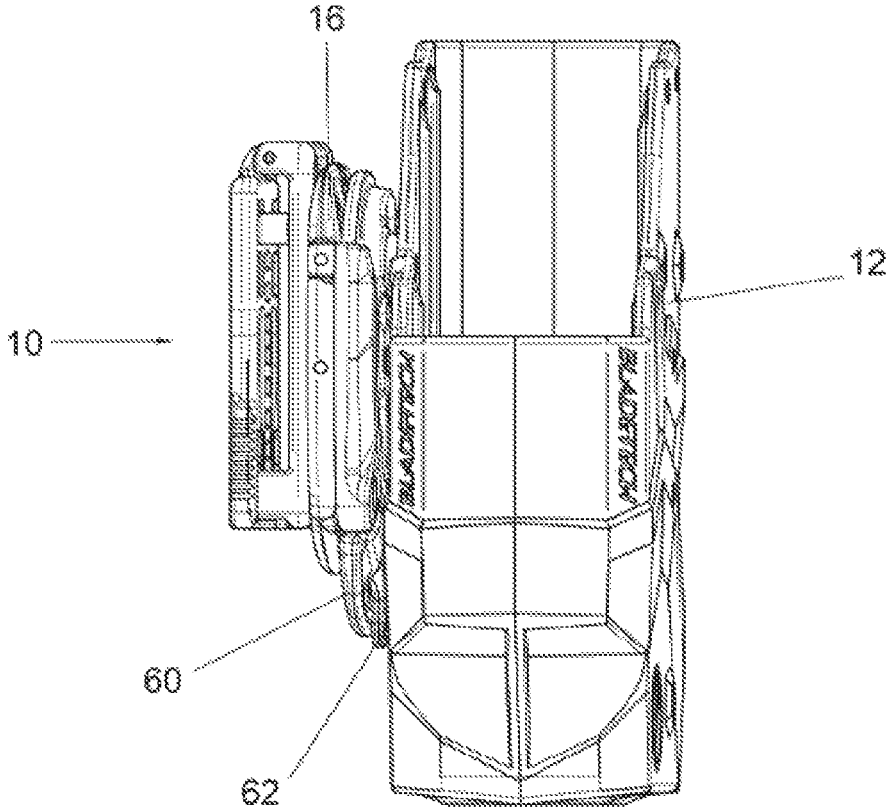
FIG. 1 is an assembled view of the interchangeable, multi location, multi cant, auto locking, quick mount structure with holster according to an exemplary embodiment.
Figure 2:
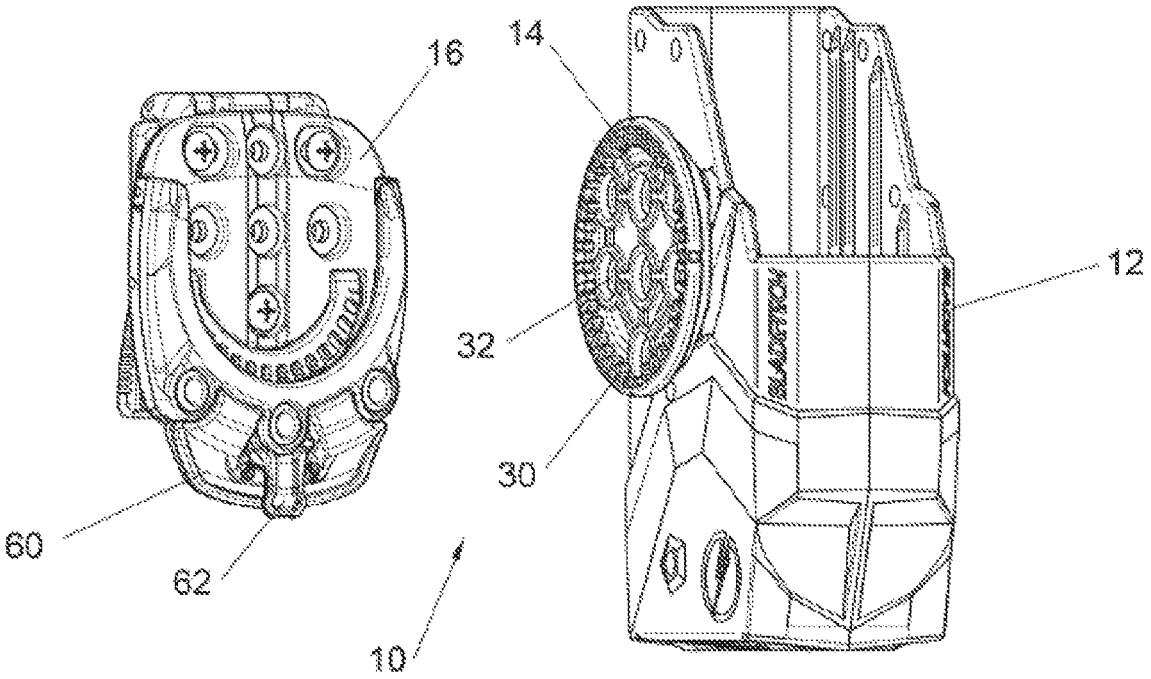
FIG. 2 is a disassembled view of the interchangeable, multi location, multi cant, auto locking, quick mount structure depicting a holster with insert plate in an engagement position with a receiver platform according to an exemplary embodiment.

Referring Now to the Drawings Wherein the Showings are for Purposes of Illustrating Embodiments of the Article Only and not for Purposes of Limiting the Same, and Wherein Like Reference Numerals are Understood to Refer to Like Components:

FIG. 1 shows the present interchangeable, multi location, multi cant, auto locking, quick mount 10 in an assembled state with a holster 12 for receiving and retaining a gun. FIG. 2 shows the interchangeable, multi location, multi cant, auto locking, quick mount 10 disassembled from the holster 12. The interchangeable, multi location, multi cant, auto locking, quick mount 10 includes an insert plate 14 that is attached to the holster 12, as additionally shown in FIGS. 4 and 5, the latter of which also shows the holster 12 with a gun 18. The interchangeable, multi location, multi cant, auto locking, quick mount 10 also includes a receiver platform 16. FIG. 2 shows the interchangeable, multi location, multi cant, auto locking, quick mount 10 in a position in which the insert plate 14 (with holster 12) can be engaged with a receiver platform 16. The receiver platform 16 of the interchangeable, multi location, multi cant, auto locking, quick mount 10 can be attached to a belt and worn on a user's hip.

As specifically shown in FIGS. 2, 4, 5, 6, 7, 9A, 10, and 11, the insert plate 14 has a generally circular profile and is configured for securement to the holster 12 (or other suitable receptacle) for removably retaining the gun 18 (or other suitable a hand-held device).

As specifically depicted in FIGS. 2, 3, 6, 8, 9A, 9B, 11 and 12, the receiver platform 16 is configured for mounting to an engagement surface (such as a belt or other surface), for removably receiving the insert plate 14. The receiver platform 16 includes an internal track 20 (best shown in phantom in FIG. 9A, 9B). The internal track 20 has a generally circular profile configured to mate with and retain the generally circular profile of the insert plate 14. The internal track 20 is connected with a slot 22 having an opening equal to the diameter of the insert plate 14, in order to allow ingress and egress of the insert plate 14 into the receiver platform 16 through the slot 22. The configuration of the internal track 20 enables rotation of the insert plate 14 to a selected cant or mounting angle with respect to the receiver platform 16, as will be explained hereinbelow. The receiver platform 16 also includes a lock mechanism 24 for releasably locking the insert plate 14 at the selected cant or mounting angle, as will also be explained hereinbelow.

FIG. 10 includes obverse and reverse views depicting details of the insert plate 14. The obverse side includes internal gear teeth 30 formed internally along a periphery of the generally circular profile of the insert plate 14. The internal gear teeth 30 are formed within a ring formed integrally onto the obverse surface of the insert plate 14. In this way the gear teeth 30 face internally toward the axis of rotation of the insert plate 14. The obverse surface of the insert plate 14 also includes a plurality of mounting holes 32 for receiving fasteners (such as nuts and bolts) for securing the insert plate 14 to a plurality of mating mounting holes 34, which are formed on the holster 12 (or other type of receptacle) for removably retaining the gun 18 (or other type of hand-held device).

As depicted in FIG. 4, two sets of the mating mounting holes 34 can be formed on both sides of the holster 12 to enable convenient interchangeable left or right hand mounting, determined by the needs of the user. The mounting holes 32 have inset recesses for receiving the heads of the fasteners. The reverse side shows the openings of the holes 32 without inset recesses. The reverse side also includes a rim 36 as indicated in FIG. 9A, 10, 12 around the periphery of the reverse face, being sized to be received and retained within the slot 22 (as indicated in the overhead view (d) of FIG. 9A). When the rim 36 of the insert plate 14 is received within the slot 22, the reverse side of the insert plate 14 is generally flush with the outside of the receiver platform 16.

As shown in FIGS. 11 and 12, external gear teeth 40 are formed on a periphery of a circular sector 42 within the internal track 20 of the receiver platform. The internal gear teeth 30 of the insert plate 14 and the external gear teeth 40 of the circular sector 42 are configured for mating engagement to retain the insert plate 14 upon selection of the selected cant or mounting angle with respect to the receiver platform 16. In other words, the internal gear teeth 30 engage the external gear teeth 40 so that the insert plate 14 is retained in a fixed angular orientation associated with the selected cant. This angular orientation is secured and maintained by the locking mechanism 24, as explained in detail hereinbelow. The internal gear teeth 30 are preferably formed onto the entire peripheral circumference of the insert plate 14, to enable 360 degrees of rotation of the insert plate 14 (and thereby, the holster 12) with respect to the receiver platform 16.

As shown in the exploded view of FIG. 12, the receiver platform 16 includes a first section 16*a* and a second section 16*b* configured in a mating arrangement and joined together with eyelets 44 and pivot pins 56 (as indicated in FIGS. 11 and 12). The internal track 20 and slot 22 are formed integrally on the interior surface of the first section 16*a*, in order to mate with a respective facing surface of the second section 16*b*. The second section 16*b* includes a series of mounting holes 46 for enabling securement via nuts and bolts to a mounting structure such a belt mount 48 (as shown in the reverse view of FIG. 3). Other types of mounting structures 48 can alternatively be employed to enable securement to a vehicle dashboard, etc.

With reference to FIGS. 1, 2, 3, 6, 9A, 9B, 11, and 12, the lock mechanism 24 is preferably a spring loaded lock 24 received within the receiver platform 16. The lock mechanism 24 is integral with the circular sector 42 having the external gear teeth 40 and thereby forms a one-piece assembly. The spring loaded lock 24 includes pivot arms 50 to enable the lock 24 to be pivotally mounted to the second section 16*b* of the receiver plate 16. The lock 24 is received into a mating recess 52 of the second section 16*b*, with mating arm sections 54 for receiving the pivot arms 50. A pivot pin 56 is received in a bore 58 formed in the side of the second section 16*a* and 16*b* that extends therethrough to engage holes in the pivot arms 50. In this manner, the spring loaded lock 24 is configured to pivot back and forth about the axis of the pivot pin 56 within the mating recess 52.

With continued reference to FIGS. 1, 2, 3, 6, 9A, 9B, 11, and 12, the spring loaded lock 24 is sufficiently springy and resilient to form a string member biased upwardly from the second section 16*b* by means of compression springs 26. The insert plate 14 (attached to the holster 12) is slid into the slot 22 of the receiver platform 16 and admitted into engagement with the internal track 20, where it encounters the spring loaded lock 24, thereby urging the lock 24 downward, thereby depressing the lock 24 and loading the spring member 26. When the insert plate 14 is slid into position, the internal gear teeth 30 of the insert plate 14 align with the external gear teeth 40 of the circular sector 42, causing the insert plate 14 to snap into place. The loaded spring member 26 of the spring loaded lock 24 is thereby urged into engagement, holding the respective gear teeth 30, 40 together against rotation, so that the insert plate 14 cannot turn within the receiver module 16. In this manner, the entire mounting module 10 is retained in non-rotatable engagement by the external gear teeth 40 engaging with the internal gear teeth 30 of the insert plate 14.

With reference to FIGS. 1, 2, 3, 6, 9A, 9B, 11, and 12, the spring loaded lock 24 further includes a lock release tab 60, configured for manual pivotal displacement of the spring loaded lock 24, that is, through depressing the lock release tab 60 by the user. As shown in FIGS. 11 and 12, the lock release tab 60 is formed of a single integral piece with the circular sector 42 and the pivot arms 50. The user's thumb manually depresses the lock release tab 60, thereby pivotally displacing the spring loaded lock 24 which loads the spring member 26 again. This causes the external gear teeth 40 on the circular sector 42 to be moved out of engagement with the internal gear teeth 30 of the insert plate 14, thereby enabling the insert plate 14 to be rotated to a different cant or rotational angle, or to be removed altogether from the receiver platform 16.

With continued reference to FIGS. 1, 2, 3, 6, 9A, 9B, 11, and 12, the lock mechanism also includes a secondary lock 62 for slidably blocking the manual pivotal displacement of the spring loaded lock 24. The secondary lock 62 is received within a channel formed in the second section 16*b* and includes a sloped surface that slides underneath the spring loaded lock 24, thereby producing a snug interference fit and thus blocks the lock release tab 60 to prevent it from being manually depressed. In this way, the internal and external gear teeth 30, 40 are held securely in place, preventing rotation or linear displacement of the insert plate 14. Thus, the secondary lock 62 prevents disengagement of the external gears 40 from the internal gears 30, which prevents any rotation and removal of the insert plate 14 with respect to the receiver platform 16.

The operation of the present interchangeable, multi location, multi cant, auto locking, quick mount 10 is specifically shown in FIG. 6. At (a), the insert plate 14 is secured into the receiver platform 16 against movement by the secondary lock 62 being in the locked position. At (b), the secondary lock 62 is moved to the release position, thereby enabling movement of the lock release tab 60. At (c), the lock release tab 60 is manually depressed, thereby loading the spring member to disengage the external gear teeth 40 from the internal gear teeth 30. At (d), the insert plate 14 is free to move, thereby enabling linear displacement to remove the insert plate 14, or rotational movement to set a different cant or mounting angle of the insert plate 14.

As explained hereinabove, in a preferred embodiment, the receptacle is a holster 14 for removably retaining a firearm. In an alternate embodiment, as depicted in FIGS. 7 and 8, the receptacle is a magazine pouch 70 for removably retaining a magazine 72 of ammunition for a firearm. The alternate embodiment includes an insert plate 14 attached to the magazine pouch 70 that cooperates with a receiver platform 16 having a belt mount 48, which can be suitably sized for use with such a smaller component. Otherwise, the alternate embodiment includes all the other corresponding components in accordance with the description provided herein above.

In the preferred embodiment, the engagement surface can be a gun belt of a wearer. The present invention can connect a holster, magazine pouch, sheath, or other article to an existing attachment or mounting platform worn on the body. Alternatively, the engagement surface can be the dashboard of a vehicle with a suitably configured mounting structure, or affixed to an item such as a backpack. The receptacle can alternatively be adapted as a belt carrier for a different hand-held device, such as smart phone or other electronic device. However, any of the foregoing components can be adapted for any other suitable implementations without departing from the invention.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. An interchangeable, multi location, multi cant, auto locking, quick mount comprising:

an insert plate having a generally circular profile and gear teeth and configured for securement to a receptacle for removably retaining a hand-held device;

a receiver platform, configured for mounting to an engagement surface, for removably, receiving the insert plate;

an internal track of the receiver platform having a generally circular profile configured to mate with and retain the generally circular profile of the insert plate, thereby enabling rotation of the insert plate to a selected mounting angle with respect to the receiver platform;

a lock mechanism received within the receiver platform and having gear teeth for mating engagement with the gear teeth of the insert plate for releasably locking the insert plate at the selected mounting angle; and a lock release tab configured to disengage the gear teeth of the lock mechanism from the gear teeth of the insert plate when manually depressed, thereby enabling rotation of the insert plate with respect to the receiver platform, and enabling removal of the insert plate with respect to the receiver platform.

2. The interchangeable, multi location, multi cant, auto locking, quick mount of claim 1, wherein:

the gear teeth of the insert plate comprise internal gear teeth formed onto a periphery of the generally circular profile of the insert plate; and the gear teeth of the lock mechanism comprise external gear teeth formed on a periphery of a circular sector within the internal track of the receiver platform;

wherein the internal and external gear teeth are configured for the mating engagement to enable the rotation of the insert plate to the selected mounting angle with respect to the receiver platform.

3. The interchangeable, multi location, multi cant, auto locking, quick mount of claim 2, wherein the external gear teeth are formed around any segment of the entire circumference of the periphery of the generally circular profile of the insert plate, to enable 360 degrees of rotation of the insert plate with respect to the receiver platform.

4. The interchangeable, multi location, multi cant, auto locking, quick mount of claim 2, wherein the lock mechanism further comprises:

a spring loaded lock received within the receiver platform, and further comprising the circular sector having the external gear teeth, wherein the spring loaded lock is pivotally, mounted to admit the insert plate into engagement with the internal track, and to retain the insert plate in non-rotatable engagement of the external gear teeth with the internal gear teeth of the insert plate; and wherein the lock release tab is configured for manual pivotal displacement of the spring loaded lock to enable rotation of the insert plate with respect to the receiver platform by disengaging the external gears from the internal gears, and to enable removal of the insert plate from the receiver platform.

5. The interchangeable, multi location, multi cant, auto locking, quick mount of claim 4, wherein the lock mechanism further comprises a secondary lock for rotationally blocking the manual pivotal displacement of the spring loaded lock to prevent disengagement of the external gears from the internal gears and thereby prevent rotation and removal of the insert plate with respect to the receiver platform.

6. The interchangeable, multi location, multi cant, auto locking, quick mount of claim 1, wherein the insert plate comprises a plurality of mounting holes for receiving fasteners for securing the insert plate to a plurality of mating mounting holes formed on the receptacle for removably retaining the hand-held device.

7. The interchangeable, multi location, multi cant, auto locking, quick mount of claim 1, wherein the receiver platform comprises a first section and a second section configured in a mating arrangement, wherein the internal track is formed integrally on an interior surface of the first section, in order to mate with a respective facing surface of the second section.

8. The interchangeable, multi location, multi cant, auto locking, quick mount of claim 1, wherein the receptacle comprises a holster for removably retaining a firearm.

9. The interchangeable, multi location, multi cant, auto locking, quick mount of claim 1, wherein the receptacle comprises a magazine pouch for removably retaining a magazine of ammunition for a firearm.

10. The interchangeable, multi location, multi cant, auto locking, quick mount of claim 1, wherein the engagement surface comprises a gun belt of a wearer.

11. The interchangeable, multi location, multi cant, auto locking, quick mount of claim 1, wherein the engagement surface comprises dashboard of a vehicle.

12. The interchangeable, multi location, multi cant, auto locking, quick mount of claim 1, wherein the selected mounting angle is a cant angle of a firearm holster.

13. A interchangeable, multi location, multi cant, auto locking, quick mount comprising:

a generally circular insert plate configured for securement to a holster for removably retaining a firearm;

a receiver platform, configured for mounting to a gun belt of a wearer, for removably, receiving the insert plate;

an internal track of the receiver platform having a generally circular profile configured to mate with and retain the generally circular profile of the insert plate, thereby enabling rotation to a selected mounting angle of the insert plate with respect to the receiver platform;

internal gear teeth formed onto a periphery of the generally circular profile of the insert plate; and external gear teeth formed on a periphery of a circular sector within the internal track of the receiver platform;

wherein the internal and external gear teeth are configured for mating engagement to enable the rotation of the insert plate to the selected mounting angle with respect to the receiver platform;

a lock mechanism for releasably locking the insert plate at the selected mounting angle, the lock mechanism further comprising:

a spring loaded lock received within the receiver platform, and further comprising the circular sector having the external gear teeth, wherein the spring loaded lock is pivotally mounted to admit the insert plate into engagement with the internal track, and to retain the insert plate in non-rotatable engagement of the external gear teeth with the internal gear teeth of the insert plate; and a lock release tab configured for manual pivotal displacement of the spring loaded lock to enable rotation of the insert plate with respect to the receiver platform by disengaging the external gears from the internal gears, and to enable removal of the insert plate from the receiver platform.

* * * * *